US008062044B2

(12) United States Patent
Montena et al.

(10) Patent No.: US 8,062,044 B2
(45) Date of Patent: Nov. 22, 2011

(54) CATV PORT TERMINATOR WITH CONTACT-ENHANCING GROUND INSERT

(75) Inventors: Noah Montena, Syracuse, NY (US); Richard Haube, Cazenovia, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/835,128

(22) Filed: Jul. 13, 2010

(65) Prior Publication Data

US 2010/0279548 A1 Nov. 4, 2010

Related U.S. Application Data

(63) Continuation-in-part of application No. 12/140,573, filed on Jun. 17, 2008, now Pat. No. 7,753,705, which is a continuation of application No. 11/553,115, filed on Oct. 26, 2006, now abandoned.

(51) Int. Cl.
*H01R 13/52* (2006.01)

(52) U.S. Cl. ..... 439/277

(58) Field of Classification Search ..... 439/277, 439/271, 583, 584, 578, 322
See application file for complete search history.

(56) References Cited

U.S. PATENT DOCUMENTS 3,184,706 A 5/1965 Atkins
3,321,732 A * 5/1967 Forney, Jr. ..... 439/322
3,336,563 A 8/1967 Hyslop
3,448,430 A * 6/1969 Kelly ..... 439/607.52
3,537,065 A 10/1970 Winston
3,646,502 A 2/1972 Hutter et al.
3,706,958 A 12/1972 Blanchenot
3,744,011 A 7/1973 Blanchenot
3,781,762 A 12/1973 Quackenbush
4,173,385 A 11/1979 Fenn et al.
4,290,663 A 9/1981 Fowler et al.
4,469,386 A * 9/1984 Ackerman ..... 439/133
4,531,805 A * 7/1985 Werth ..... 439/607.27
4,655,534 A * 4/1987 Stursa ..... 439/582
4,807,891 A * 2/1989 Neher ..... 277/392
5,011,422 A * 4/1991 Yeh ..... 439/307
5,046,964 A * 9/1991 Welsh et al. ..... 439/271
5,052,947 A * 10/1991 Brodie et al. ..... 439/607.01
5,055,060 A * 10/1991 Down et al. ..... 439/304
5,137,471 A 8/1992 Verespej et al.
5,183,417 A * 2/1993 Bools ..... 439/607.5
5,389,005 A 2/1995 Kodama
5,735,704 A * 4/1998 Anthony ..... 439/271
6,331,123 B1 12/2001 Rodrigues
6,406,330 B2 * 6/2002 Bruce ..... 439/607.19
6,491,546 B1 * 12/2002 Perry ..... 439/620.03
6,716,062 B1 4/2004 Palinkas et al.
6,733,336 B1 * 5/2004 Montena et al. ..... 439/578
6,884,113 B1 * 4/2005 Montena ..... 439/578
(Continued)

*Primary Examiner* — T C Patel
*Assistant Examiner* — Vladimir Imas
(74) *Attorney, Agent, or Firm* — Schmeiser, Olsen & Watts, LLP

(57) ABSTRACT

A port terminator includes an outer nut, which may be either electrically conductive or non-electrically conductive, and an electrically conductive ground insert. A portion of the ground insert captures a ground portion of a termination resistor, while a deformable portion of the ground insert makes electrical contact with a connection end of an equipment port when the port terminator is screwed onto the equipment port. The deformable portion can take the form of a flexible brim or a plurality of petals. The petals preferably alternate between flat petals and biased petals. The ground insert permits the port terminator to make a uniform RF seal on an equipment port even with a range of tightening torques.

20 Claims, 11 Drawing Sheets

U.S. PATENT DOCUMENTS

| | | | | |
|---|---|---|---|---|
| 6,929,508 | B1 | 8/2005 | Holland | |
| 7,070,477 | B2 | 7/2006 | Montena | |
| 7,086,897 | B2 * | 8/2006 | Montena | 439/578 |
| 7,097,499 | B1 * | 8/2006 | Purdy | 439/578 |
| 7,102,868 | B2 * | 9/2006 | Montena | 361/119 |
| 7,114,990 | B2 * | 10/2006 | Bence et al. | 439/583 |
| 7,131,868 | B2 | 11/2006 | Montena | |
| 7,156,696 | B1 | 1/2007 | Montena | |
| 7,161,785 | B2 * | 1/2007 | Chawgo | 361/119 |
| 7,299,550 | B2 | 11/2007 | Montena | |
| 7,452,239 | B2 * | 11/2008 | Montena | 439/620.03 |
| 7,479,035 | B2 * | 1/2009 | Bence et al. | 439/583 |
| 7,753,705 | B2 * | 7/2010 | Montena | 439/277 |
| 7,824,216 | B2 * | 11/2010 | Purdy | 439/578 |
| 7,892,005 | B2 * | 2/2011 | Haube | 439/321 |
| 2002/0013088 | A1 | 1/2002 | Rodrigues et al. | |
| 2005/0148236 | A1 | 7/2005 | Montena | |
| 2006/0009074 | A1 | 1/2006 | Montena | |
| 2006/0110977 | A1 | 5/2006 | Matthews | |
| 2006/0172571 | A1 | 8/2006 | Montena | |
| 2008/0102696 | A1 * | 5/2008 | Montena | 439/578 |
| 2010/0279548 | A1 * | 11/2010 | Montena et al. | 439/620.04 |

* cited by examiner

CATV PORT TERMINATOR WITH CONTACT-ENHANCING GROUND INSERT

CROSS-REFERENCE TO RELATED APPLICATIONS

This application is a continuation-in-part of and claims priority from U.S. patent application Ser. No. 12/140,573 filed on Jun. 17, 2008, now U.S. Pat. No. 7,753,705 and entitled FLEXIBLE RF SEAL FOR COAXIAL CABLE CONNECTOR, which is a continuation of and claims priority from U.S. application Ser. No. 11/553,115 filed Oct. 26, 2006 and entitled FLEXIBLE RF SEAL FOR COAXIAL CABLE CONNECTOR, now, abandoned, both of which are incorporated herein by reference.

FIELD OF THE INVENTION

This invention relates generally to the field of CATV port terminators, and more particularly to a port terminator which incorporates a contact-enhancing ground insert for a termination resistor.

BACKGROUND OF THE INVENTION

CATV systems continue to be plagued with service quality problems resulting from loose connections. For the most part, these connectors are loose because they were not installed to the proper torque, which can occur for a number of reasons from laziness, a lacking of training, and improper use of/inadequate tools. An improperly installed connector will result in poor signals, because there are gaps between the devices, resulting in a leak of radio frequency ("RF") signal.

As an example, a cable port is used to transfer an RF signal to a coaxial cable that transmits the signal to video equipment, such as a television. The coaxial cable has, attached to its terminal end, a female cable connector, which is used to house the cable and assist its connection to a cable port. The connector contains a nut that engages the cable port and advances the connector with a coaxial cable to the port. In this instance, the cable connector nut is used to hold two mating surfaces, the cable port and the cable connector housing the coaxial cable. If these two surfaces are not tightly connected, a gap will exist creating a loss in RF signal, resulting in lower quality cable signal.

Improvements on coaxial cable connectors have been proposed to deal with such a problem. An example of such an improvement on a connector is described in U.S. Pat. No. 6,716,062 (Palinkas, et al.), the disclosure of which is herein incorporated by reference. In this patent, a spring element is incorporated to a traditional coaxial cable connector, under a nut element and beneath the flange portion of a post member. The spring biases the connector face towards a port after the nut is rotated around the connector a certain number of times. While this device is effective, it requires time and cost in the manufacturing process of the connector.

In addition, in high density urban CATV systems, it is often common practice to place equipment, such as taps, based on the total housing density instead of the actual subscriber density. In some countries, such as Great Britain, this is required by law, resulting in 100 taps installed for a 100-dwelling apartment building even if there are only 30 CATV subscribers. As a result, it is not unusual for there to be unused ports, particularly in systems with low penetration. When unused ports are left unterminated, or are terminated with port connectors which are easily left loose by the installer, or which become loose with the vibrations common to an urban environment, significant degradation to CATV service occurs.

SUMMARY OF THE INVENTION

Briefly stated, a port terminator includes an outer nut, which may be either electrically conductive or non-electrically conductive, and an electrically conductive ground insert. A portion of the ground insert captures a ground portion of a termination resistor, while a deformable portion of the ground insert makes electrical contact with a connection end of an equipment port when the port terminator is screwed onto the equipment port. The deformable portion can take the form of a flexible brim or a plurality of petals. The petals preferably alternate between flat petals and biased petals. The ground insert permits the port terminator to make a uniform RF seal on an equipment port even with a range of tightening torques.

According to an embodiment of the invention, a port terminator for use in a coaxial cable system includes an outer nut; the outer nut having first and second chambers; an inside of the first chamber having at least one thread therein; a ground insert positioned inside the second chamber; the ground insert being electrically conductive; the ground insert having a capture portion, a middle portion, and a deformable portion, with the capture portion connected to the middle portion, and the middle portion connected to the deformable portion via a transition band; a termination resistor including a ground portion, an insulator portion, and a conductor portion, wherein an electrical resistance is electrically connected between the conductor portion and the ground portion and surrounded by the insulator portion; and the ground portion of the termination resistor being held inside and making electrical contact with the capture portion of the ground insert.

According to an embodiment of the invention, a method for manufacturing a port terminator for use in a coaxial cable system includes the steps of forming an outer nut having first and second chambers; forming at least one thread on an inside of the first chamber; forming an electrically conductive ground insert, wherein the ground insert includes a capture portion, a middle portion, and a deformable portion, with the capture portion connected to the middle portion, and the middle portion connected to the deformable portion via a transition band; positioning the ground insert inside the second chamber; providing a termination resistor including a ground portion, an insulator portion, and a conductor portion, wherein an electrical resistance is electrically connected between the conductor portion and the ground portion and surrounded by the insulator portion; positioning the ground portion of the termination resistor inside the capture portion of the ground insert; and fastening the ground portion of the termination resistor to the capture portion of the ground insert, thereby making good electrical contact between the termination resistor and the ground insert.

According to an embodiment of the invention, a port terminator for use in a coaxial cable system includes an outer nut; the outer nut having first and second chambers; an inside of the first chamber having at least one thread therein; a ground insert positioned inside the second chamber; the ground insert being electrically conductive; a termination resistor including a ground portion, an insulator portion, and a conductor portion, wherein an electrical resistance is electrically connected between the conductor portion and the ground portion and surrounded by the insulator portion; the ground insert including means for receiving and being electrically connected to the ground portion of the termination resistor; and the ground insert further including deformable means for establishing electrical contact with a connector end of an equipment port when the port terminator is connected to the equipment port, such that an electrical path is established from a conductor port of the equipment port to the termination resistor to the ground insert to the connector end of the equipment port.

DETAILED DESCRIPTION OF THE PREFERRED EMBODIMENT

Figure 1B:
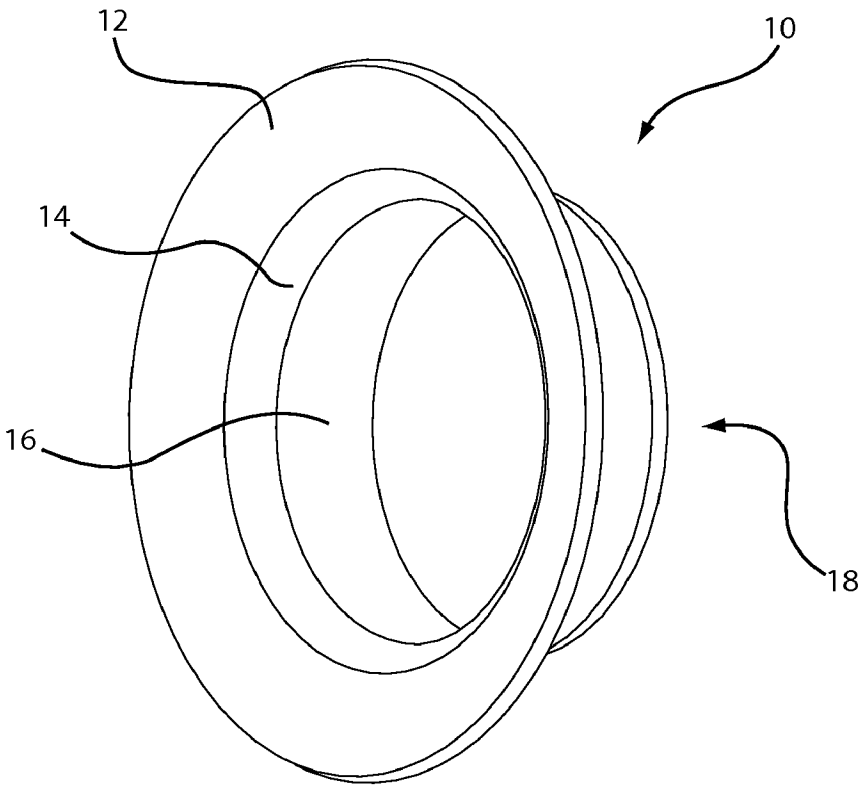
FIG. 1B shows an isometric view of the first embodiment of the flexible RF seal of the parent application.
Figure 1A:
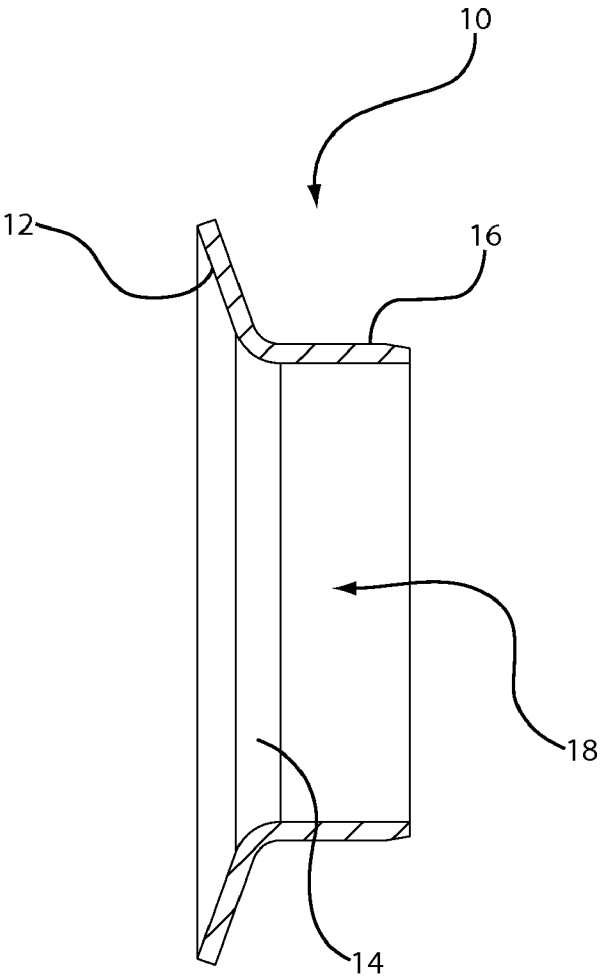
FIG. 1A shows a cross-sectional view of the first embodiment of the flexible RF seal of the parent application.

Referring to FIGS. 1A and 1B, a sealing element for a coaxial cable connector 100 (FIGS. 3-4) is shown. More specifically, the sealing element is designed to ensure a solid mechanical and electrical connection between a coaxial cable, connector and part, and thereby termed a flexible radio frequency ("RF") seal 10. There are three regions that define the flexible RF seal 10. First, there is a flexible or resilient brim 12 that is flexible for ensuring a tight connection between a connector and a cable port (not shown) to which it is coupled. Second, there is a transition band 14, and the band 14 transitions to a tubular insert portion 16. The flexible RF seal 10 also has an insert chamber 18 defined within the seal 10.

The flexible brim 12 is a flange end that, when inserted into a coaxial cable connector, in its first embodiment, sits above a post member, as will be shown and described in greater detail below. The flexible brim 12, in this position, can be pressed against a coaxial port causing the flexible brim 12 to be compressed and bent so that it creates a tight connection between the connector and port. In the first embodiment of the flexible RF seal 10, the flexible brim 12, because of the inner geometries of the coaxial cable connector, is angled, so that it can sit within the connector and seal the connector face to the cable port. Preferably, the flexible brim 12 is seventy-degrees (70°) from the horizontal. The flexible brim 12 is shaped such that the flexible brim 12 is angled away from an insert chamber 18.

The next region of the flexible RF seal 10 is the transition band 14. Due to the shape of cable connectors in general and the positioning of the flexible RF seal within the connector, there is a band 14 that transitions the flexible brim 12 to the tubular insert portion 16. As shown in FIGS. 1A and 1B, the transition band 14 is a flat, inclined portion on the inside of the seal 10. The transition band 14 assists in the flexibility of the seal 10, in that as a transition portion it allows the flexible brim 12 to further bend or create a greater angle of distance once the flexible brim 12 is engaged by a coaxial port on one end and further compressed by a post member of a connector on its other end.

Figure 3:
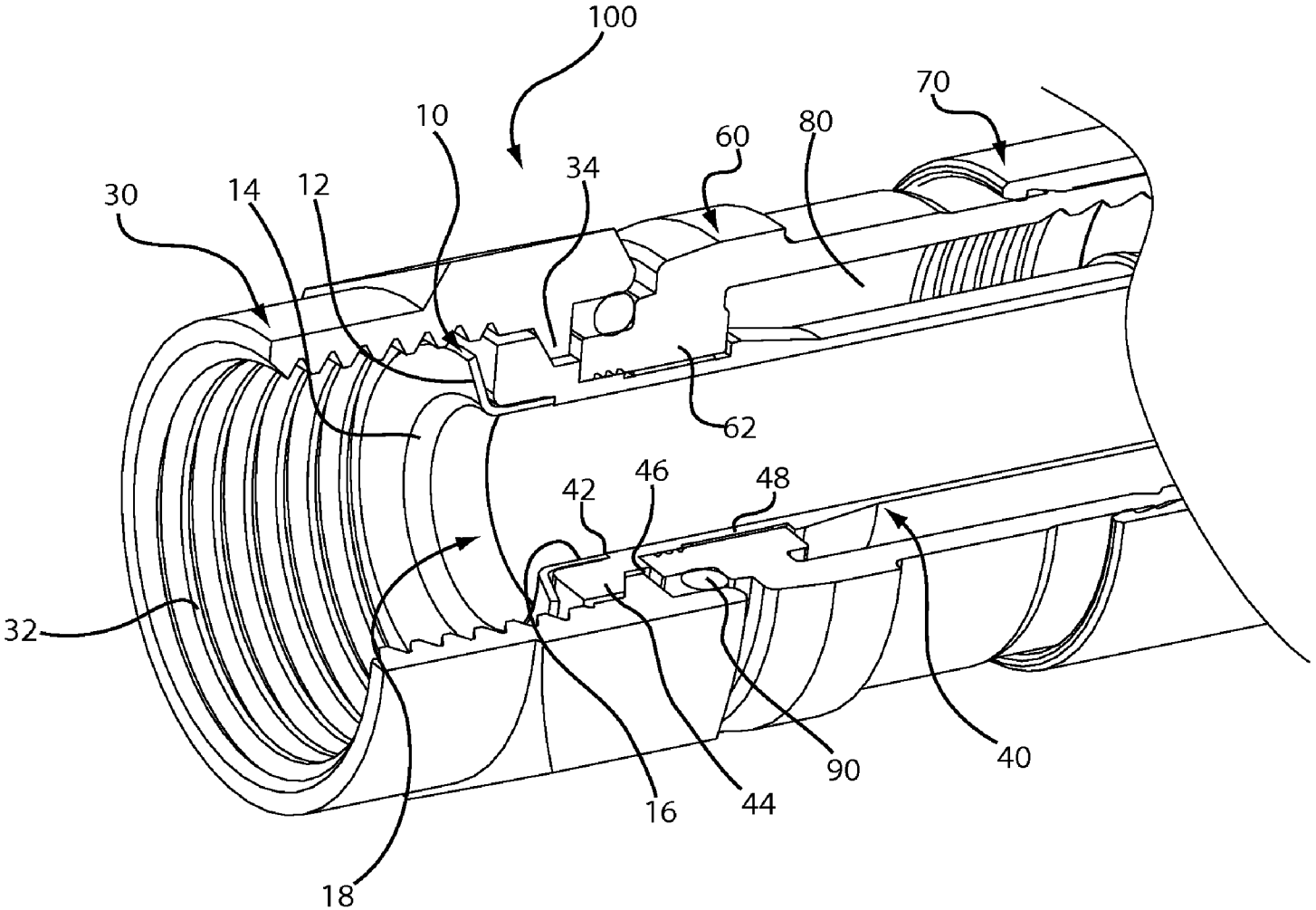
FIG. 3 shows a cross-section of the coaxial cable connector with the first embodiment of the flexible RF seal of the parent application.

The last region of the flexible RF seal is the tubular insert portion 16. The tubular insert portion 16 is below the transition band 14. The tubular insert portion 16 is cylindrical in shape and depending on its embodiment can be used to sit on the inside or outside of a post within a coaxial cable connector. Defined within the tubular insert portion 16 is an insert chamber 18. The tubular insert portion 16, in the first embodiment of the flexible RF seal 10, sits within a post member of a cable connector (as shown in FIG. 3). As a result, the insert chamber 18 assists in housing a coaxial cable on which the cable connector is placed.

Figure 2B:
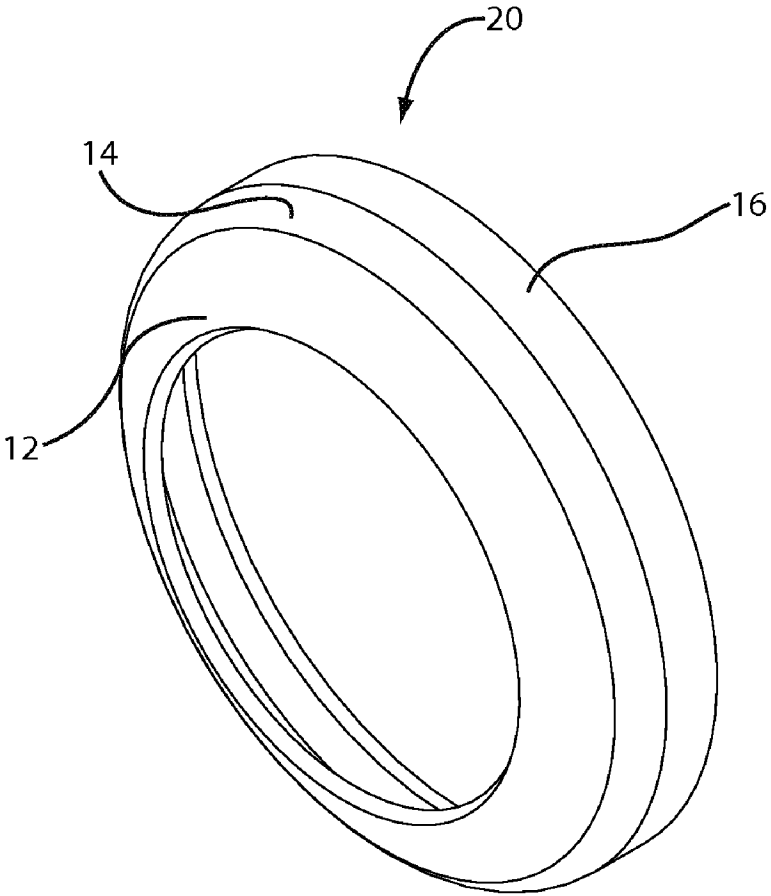
FIG. 2B shows an isometric view of the second embodiment of the flexible RF seal of the parent application.
Figure 2A:
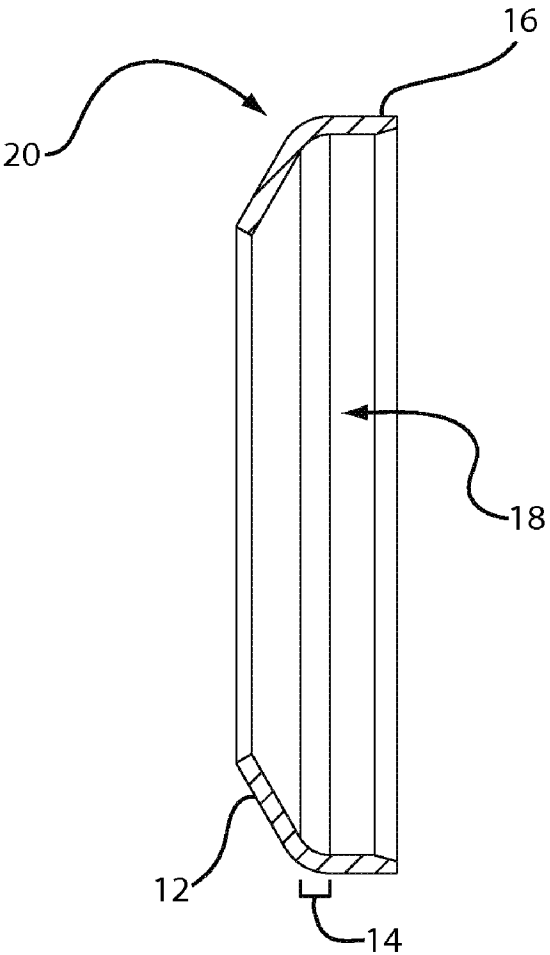
FIG. 2A shows a cross-sectional view of the second embodiment of the flexible RF seal of the parent application.

Referring to FIGS. 2A and 2B, there is a second embodiment of the flexible RF seal, denoted by a reference numeral 20. The flexible RF seal 20 has the same three regions as the first embodiment: a flexible brim 12, a transition band 14, and a tubular insert 16. Further, defined within the flexible RF seal 20, as with the first embodiment 10, is an insert chamber 18. The flexible RF seal 20 of this second embodiment has a different shape than the first embodiment 10. The shapes are different because the seal 20 is configured to sit inside a post member instead of above the post member as is the case for the embodiment of FIGS. 1A-1B. The flexible brim 12 is spaced such that the brim 12 is angled inward towards the insert chamber 18. Moreover, the tubular insert 16 of the flexible RF seal 20 may generally be larger in diameter than the seal 10 because the tubular insert 16 is configured to sit outside of the post member of the coaxial cable connector.

The flexible RF seal 10, 20 can be made of any suitable material which can assist in providing a tight, solid physical and electrical connection between the surfaces of a coaxial cable connector and a cable port. Suitable materials can include metals such as beryllium copper, spring steel, and phosphor bronze, which are all resilient and allow for flexibility. Further, while the flexible RF seals 10, 20 are shown in with a solid, smooth surface, the seal can have a construction where there are fingered elements, or may further have a wavy construction.

Figure 4:
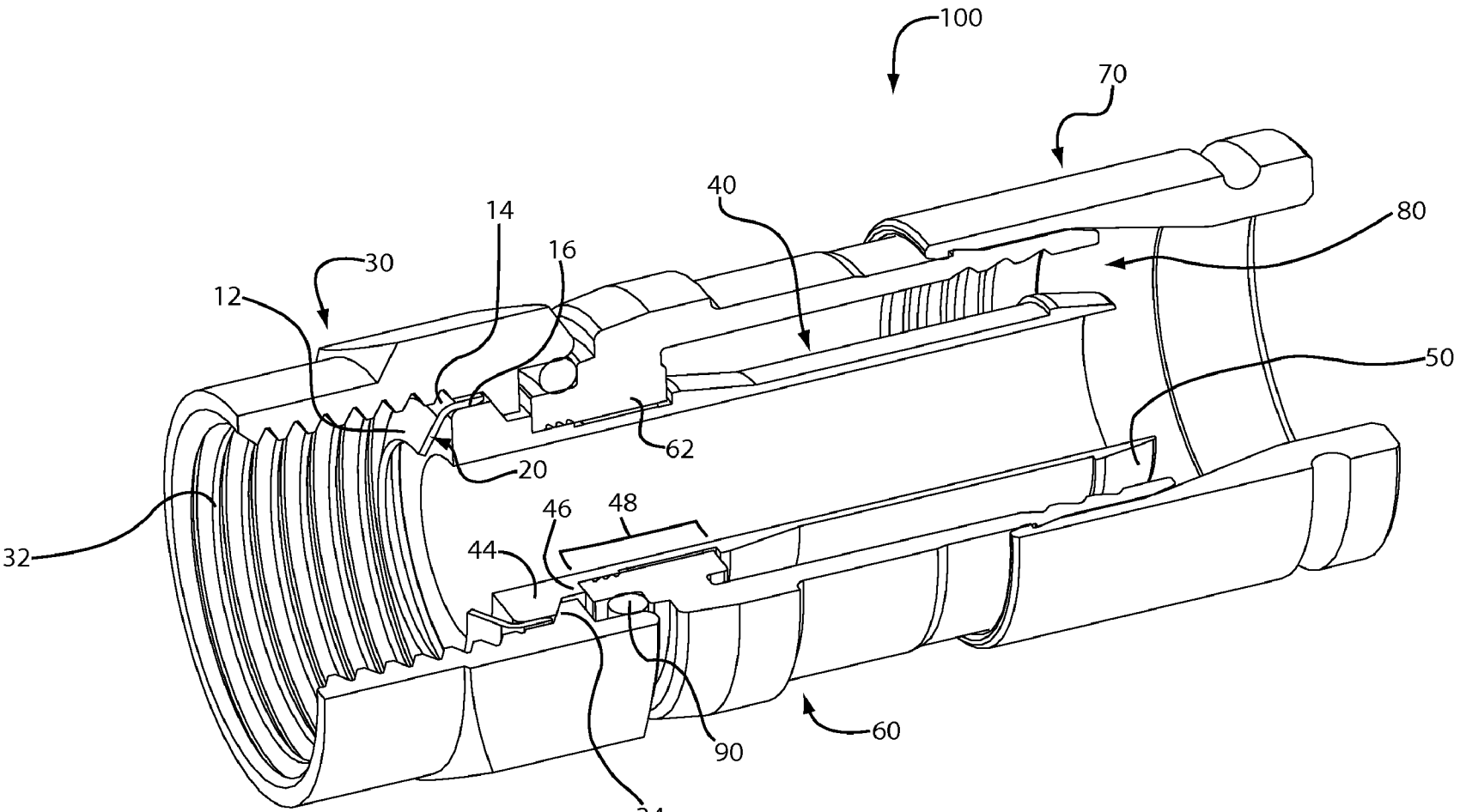
FIG. 4 shows a cross-section of the coaxial cable connector with the second embodiment of the flexible RF seal of the parent application.

In FIGS. 3 and 4, there is shown a conventional coaxial cable connector 100 that is placed on the terminal end of a coaxial cable (not shown). The connector 100 has six elements. First, there is a nut 30 on the terminal end of the connector 100 to attach connector 100, whose other end is attached to a coaxial cable (not shown), to a cable port (not shown). The nut 30 rotates freely around a post 40, so that it can advance the connector 100 and coaxial cable housed within it to a cable port. The nut 30 is interconnected to the post 40 under the flange end 44 of the post 40, whereby there is a nut groove 46 created between the post 40 and a body member 60. Specifically, the nut groove 46 is bounded by a flange end 44 of the post 40 and above an end of a body flange 62. The corresponding nut flange 34 that fits within the nut groove 46 and allows the nut 20 to freely rotate about the connector 100. The post 40 has a cylindrical bore defined through it to house portions of the coaxial cable.

Further, between the nut 30 and the body member 60 is a coupling element 90, such as an O-ring to provide a weathertight connection between these elements. The body member 60 is also connected to the post 40 through a larger body groove 48, in which a portion of the body flange 62 fits. Defined between the body member 60 and the post 40 is a coaxial cable material space 80. A coaxial cable is typically made from several components. Working from the inside to the outside, the inner most part of a cable is a central conductor surrounded by an inner dielectric layer which is covered by a layer of aluminum. Outside the aluminum layer is a braided metal layer, with the entire cable then housed in another dielectric material. There is a lower separator member 50 (FIG. 4) of post 40 which separates the coaxial cable between its aluminum layer and braided metallic layer, so that the outer dielectric layer and braided metal layer enter the coaxial cable material space 80, while the aluminum layer, inner dielectric layer, and central conductor layer sit in the cylindrical bore 82 of the post 40. At the opposite end of the connector 100 from nut 30 is a compression ring 70 which assists in attaching the connector 100 to a prepared end of the coaxial cable.

Referring now to FIG. 3, the first embodiment of the invention is shown coupled to conventional coaxial cable connector 100. The post 40 has a lip 42 on which the flexible RF seal 10 sits. The tubular insert 16 sits within the post 40, such that the insert chamber 18 assists in creating a continuous cylindrical bore within which a portion of a coaxial cable (not shown) would be housed. The flexible brim 12 sits above the flange end 44 of the post 40, but is not flush with the flange end 44. The flexible brim 12 is not flush with the flange end 44 so that it can conform to shapes of a cable port (not shown) and the connector 100, and to a greater extent the cable housed within the connector, as sometimes there can be gaps between the cable port and the inner portions of the connector 100 with a cable. As mentioned above, the flexible brim 12 can be, if necessary, pushed backward so that the angle from the horizontal increases from its manufactured positioning. Moreover, the flexible brim 12 can be deformed to ensure an RF-tight connection between the post 40 and the cable port.

Referring to FIG. 4, the second embodiment of the seal 20 is shown coupled to connector 100. The seal 20 sits on the outside of the flange end 44 of the post 40. In this position, an end of tubular insert portion 16 abuts the seal 20 and the nut flange 34, with a remainder of tubular insert portion 16 sandwiched between the flange end 44 of the post 40 and a portion of nut 30. The flexible brim 12 extends past the flange end 44, but is not flush with the flange end 44 so that it can adapt to the shape of both the cable port and the connector 100 with the coaxial cable housed within it. In this embodiment, the post 40 does not require a lip 42, as was shown in FIG. 3 with the seal 10. Once the connector 100 engages the cable port and is advanced to have an inner conductor of the cable enter the port, the seal 20 can be deformed to a position necessary to fill gaps or tightly connect, physically and electrically, the connector 100 to the port.

Figure 5:
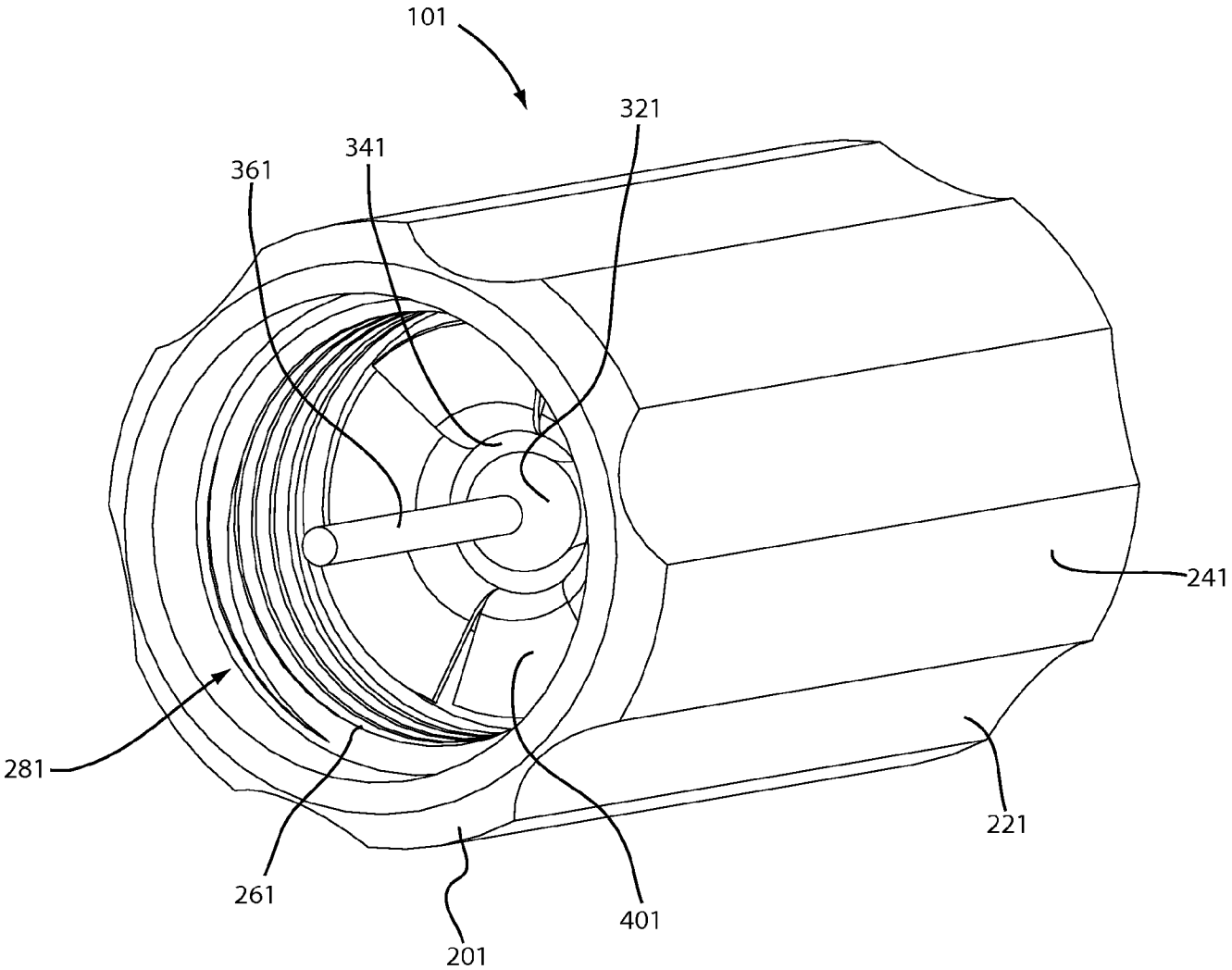
FIG. 5 shows a perspective view of a CATV port terminator according to an embodiment of the invention.

Referring to FIG. 5, a port terminator 101 is shown. As is known in the art, a port terminator is fastened into an unused port of a device to provide an environmental seal to protect the inside components of the device and to provide an electrical "appearance" to the circuitry of the device that is neutral. That is to say, if the device expects to see a cable connector with 75 ohms of impedance at a given port, the port terminator provides the 75 ohms of impedance the device is looking for.

Figure 11:
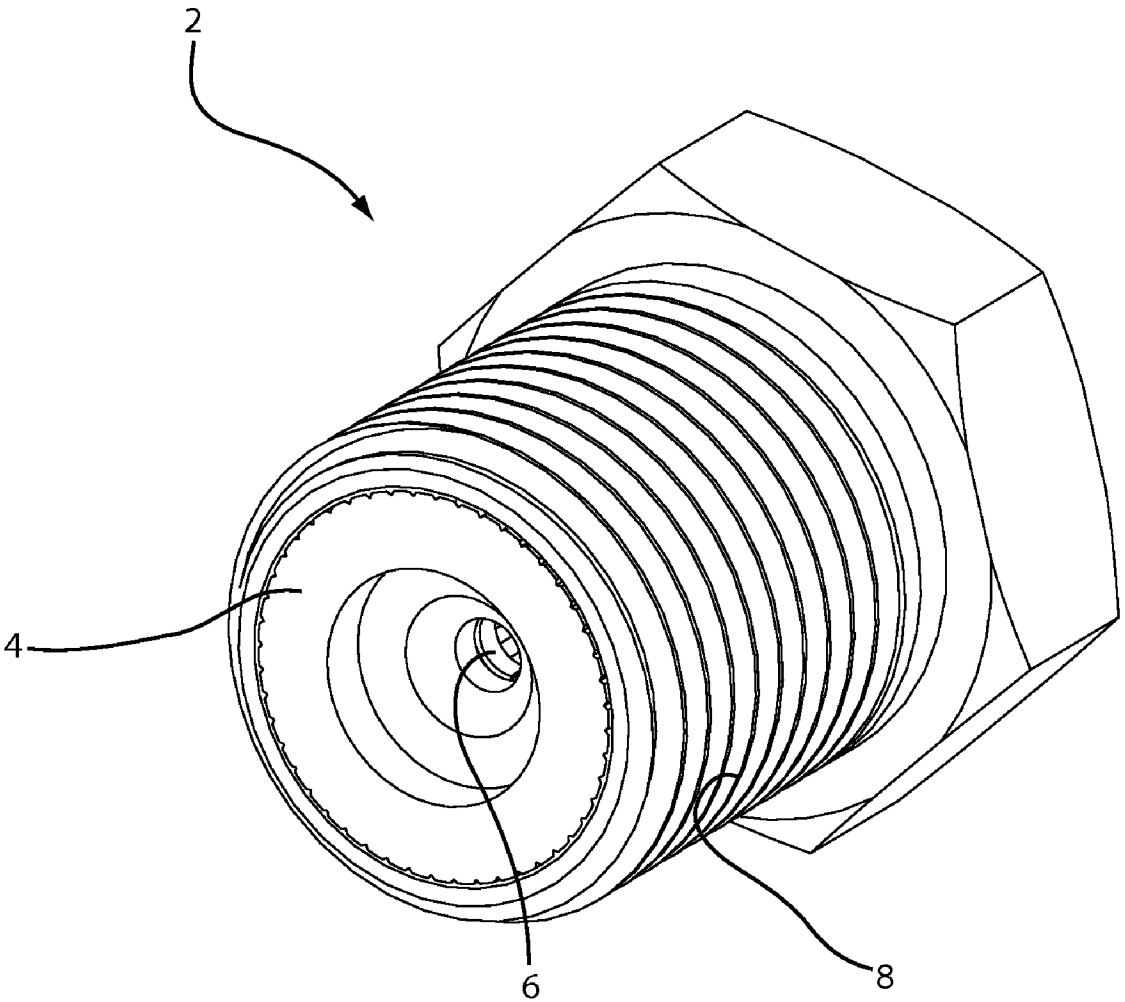
FIG. 11 shows a perspective view of an example of an equipment port.

Referring also to FIG. 11, an equipment port 2 is shown, which includes a connector end 4, a conductor port 6, and at least one thread 8.

Port terminator 101 includes an outer nut 201 which has a plurality of grooves 221 and ridges 241 to enhance contact between an installer's fingers (not shown) and port terminator 101 during installation and removal. At least one thread 261 on an inside of one end of outer nut 201 permits port terminator 101 to be screwed onto port 2 of a device (not shown). A termination resistor 321, which can be in the form of a peanut resistor, is positioned inside an insert chamber 403 and a nut chamber 281 of outer nut 201 as will be explained later.

Figure 6:
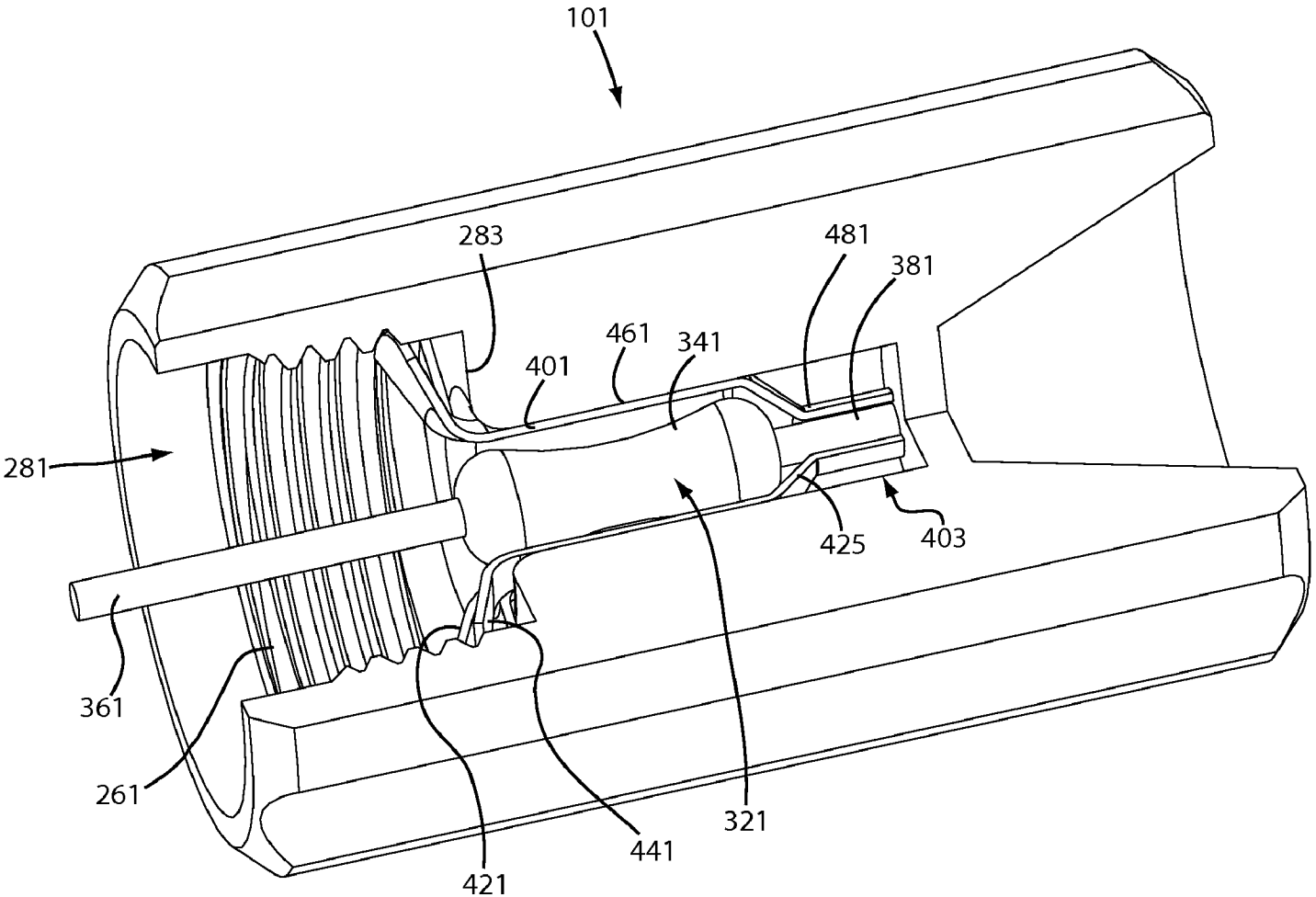
FIG. 6 shows a partially cutaway view of a CATV port terminator according to an embodiment of the invention.
Figure 7:
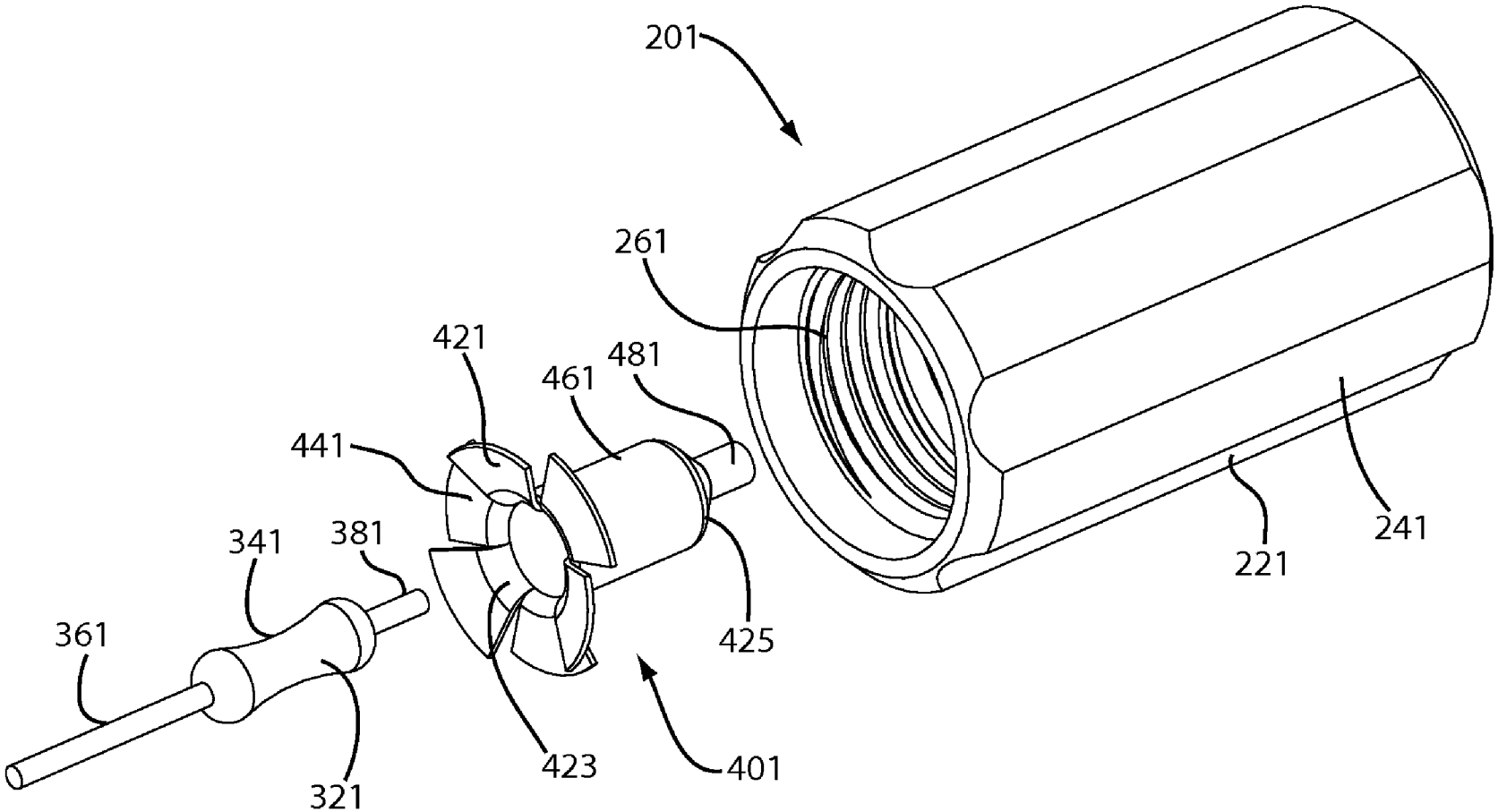
FIG. 7 shows an exploded view of a CATV port terminator according to an embodiment of the invention.

Referring also to FIGS. 6-7, termination resistor 321 includes an insulator 341 surrounding an electrical resistance, a conductor portion 361, and a ground portion 381. Conductor portion 361 is designed to enter equipment port 2 and connect with the device (not shown) in the same manner as a center conductor of a coaxial cable (not shown). The electrical path runs from conductor port 6 to conductor portion 361, through termination resistor 321 to ground portion 381, to a ground insert 401, and then to connector end 4. Outer nut 201 is preferably made of injection molded plastic, and is preferably non-electrically conductive, but can optionally be made of an electrically conductive material in which case the use of ground insert 401 permits good port termination even if the outer nut is not screwed tightly onto equipment port 2.

Nut chamber 281 is cylindrical and contains at least one thread 261 therein, with a diameter sized to screw onto equipment port 2. Insert chamber 403 is also cylindrical, but is of a smaller diameter than nut chamber 281. Ground insert 401 is preferably press-fit into insert chamber 403 within outer nut 201. Ground insert 401 is of an electrically conductive material, preferably metal, although other electrically conductive materials are known in the art. Ground insert 401 includes a capture portion 481 for capturing (receiving) and making good electrical contact with ground portion 381 of termination resistor 321. An angled portion 425, frustoconical in shape, connects capture portion 481 with a middle portion 461 of ground insert 401. Middle portion 461 is preferably sized so that its outer surface makes contact with the walls of insert chamber 403, while its inner surface helps to hold termination resistor 321 in place.

Termination resistor 321 is preferably connected to capture portion 481 of ground insert 401 in one of several ways to improve both the electrical connection and the physical connection. For example, termination resistor 321 could be crimped into capture portion 481, or it could be soldered. One method of connection would be to insert termination resistor 321 into capture portion 481 and then crimp capture portion 481 onto termination resistor 321. Another method of connection would be to partially crimp capture portion 481 and then insert termination resistor 321 into capture portion 481.

Middle portion 461 of ground insert 401 connects to a plurality of flat petals 441 and biased petals 421 via a transition band 423. Flat petals 441 are preferably alternated with biased petals 421. When port terminator 101 is screwed onto equipment port 2, petals 441, 421 are preferably forced onto connector end 4, and possibly onto thread 261 and/or a flat portion 283 of outer nut 201 which separates insert chamber 403 from nut chamber 281. The partial deformation of petals 421, 441 ensures excellent electrical contact between ground insert 401 and connector end 4 of equipment port 2 and provides enhanced RF shielding.

Figure 8:
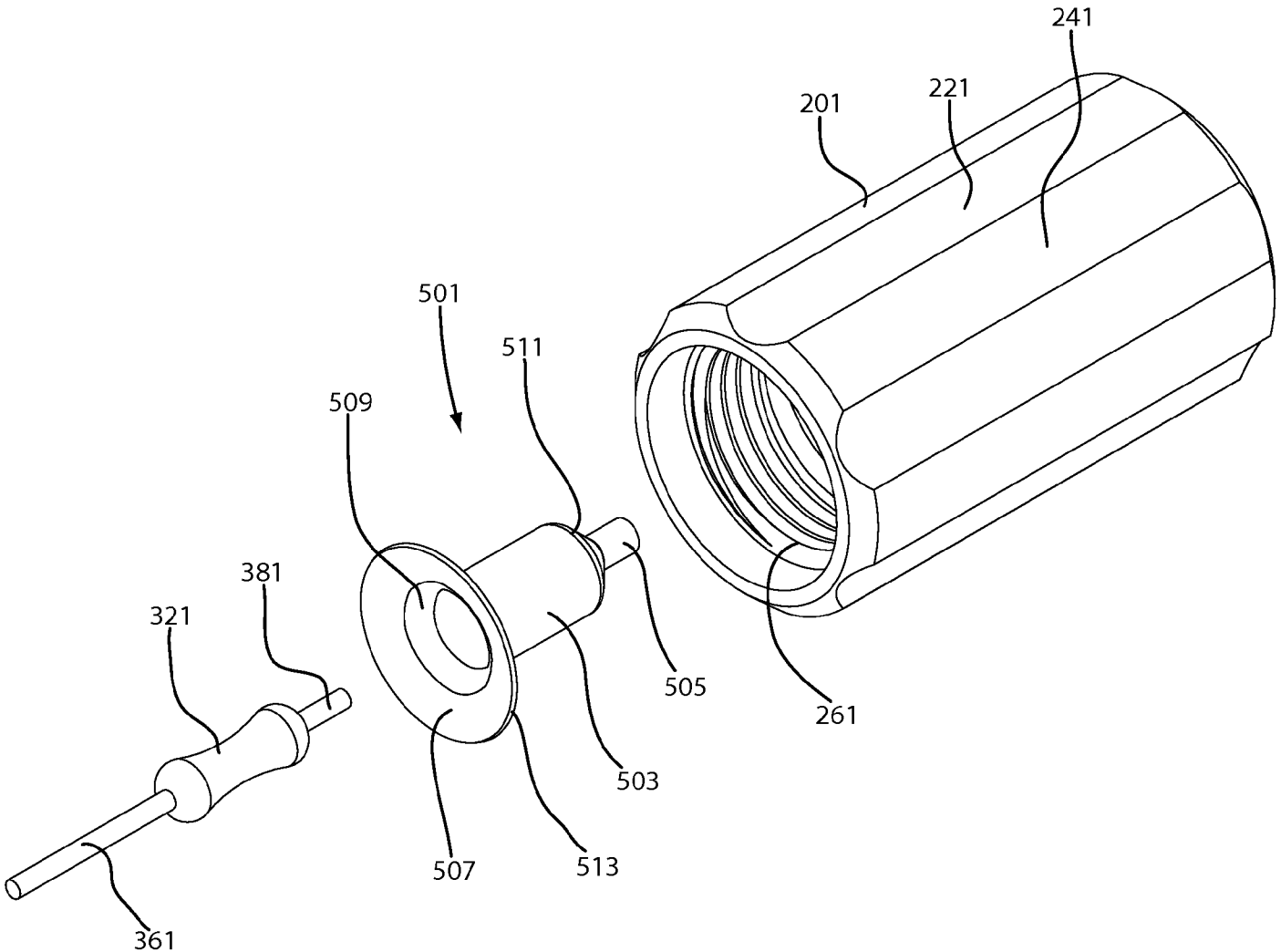
FIG. 8 shows an exploded view of a CATV port terminator according to an embodiment of the invention.
Figure 9:
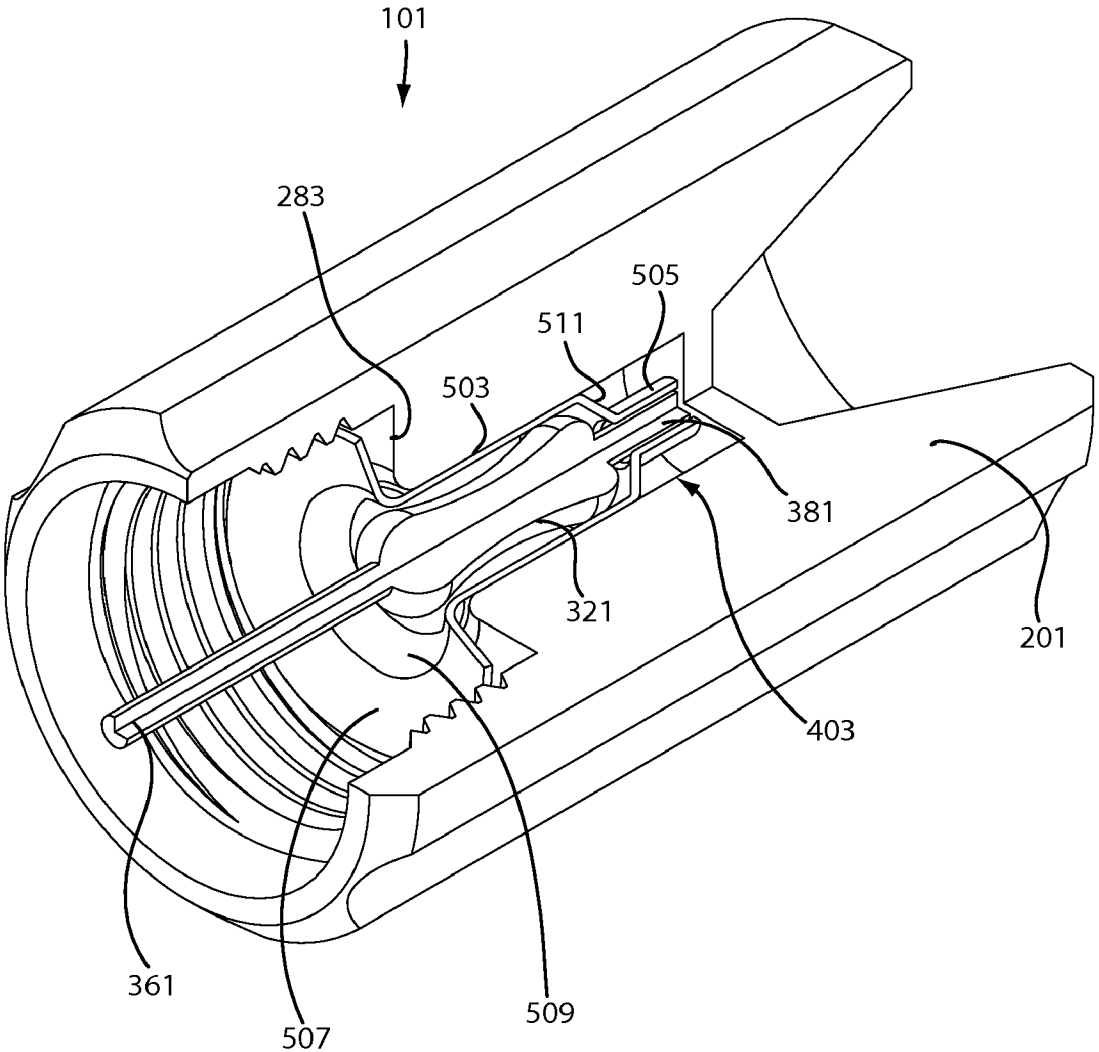
FIG. 9 shows a partially cutaway view of a CATV port terminator according to an embodiment of the invention.
Figure 10:
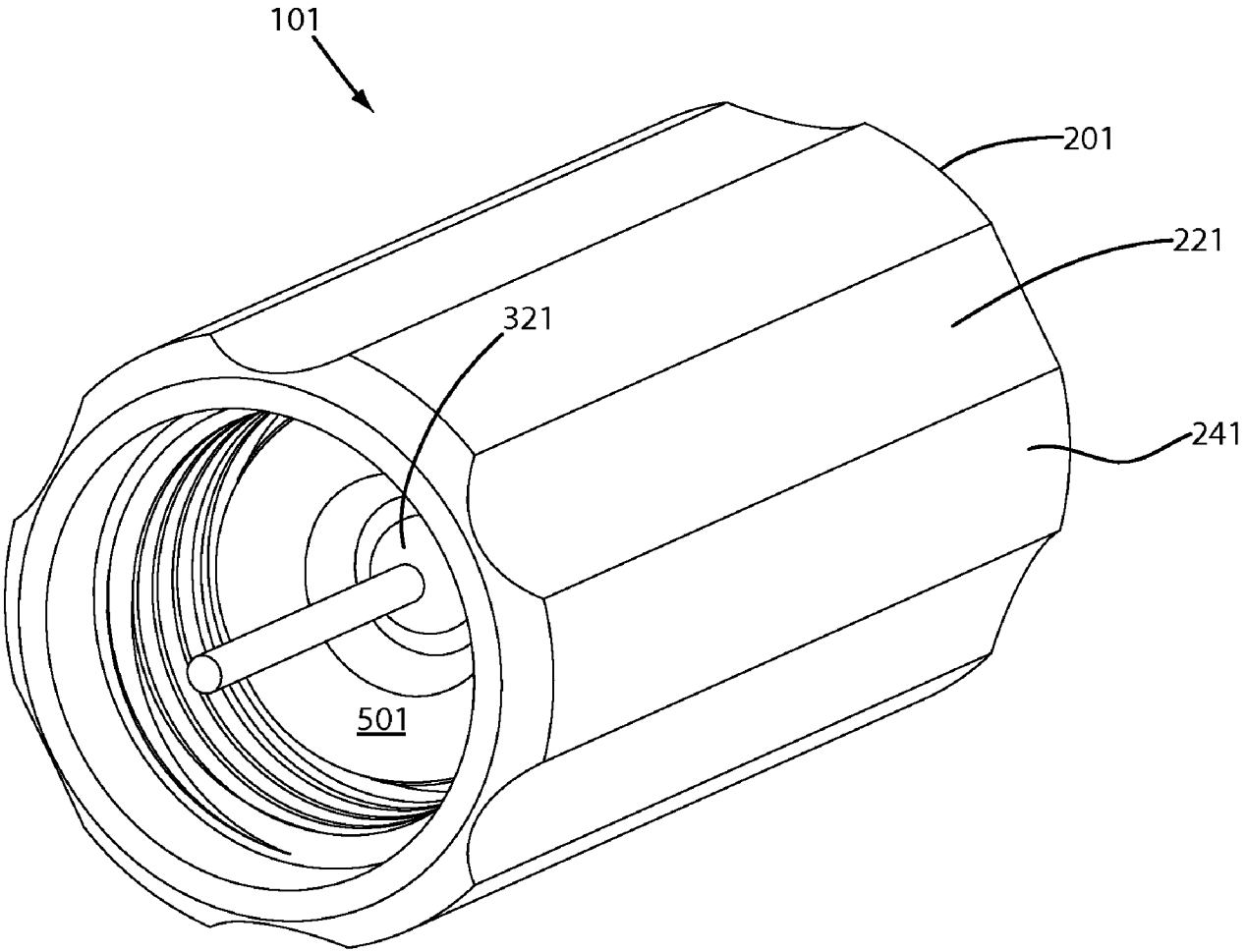
FIG. 10 shows a perspective view of a CATV port terminator according to an embodiment of the invention.

Referring to FIGS. 8-10, a ground insert 501 is shown which is similar to ground insert 401 except that instead of petals, a flexible brim 507 is used. Ground insert 501 fits into insert chamber 403 within outer nut 201. Ground insert 501 is of an electrically conductive material, preferably metal, although other electrically materials are known in the art. Ground insert 501 includes a capture portion 505 for capturing (receiving) and making good electrical contact with ground portion 381 of termination resistor 321. An angled portion 511, frustoconical in shape, connects capture portion 505 with a middle portion 503 of ground insert 501. Middle portion 503 is preferably sized so that its outer surface makes electrical contact with the walls of insert chamber 403, while its inner surface helps to hold termination resistor 321 in place.

As with the previous embodiment, termination resistor 321 is preferably connected to capture portion 505 of ground insert 501 in one of several ways to improve both the electrical connection and the physical connection. For example, termination resistor 321 could be crimped into capture portion 505, or it could be soldered. One method of connection would be to insert termination resistor 321 into capture portion 505 and then crimp capture portion 505 onto termination resistor 321. Another method of connection would be to partially crimp capture portion 505 and then insert termination resistor 321 into capture portion 505.

Middle portion 503 of ground insert 501 connects to flexible brim 507 via a transition band 509. When port terminator 101 is screwed into equipment port 2, flexible brim 507 is preferably forced against connector end 4, and possibly onto flat portion 283 of outer nut 201 which separates insert chamber 403 from nut chamber 281. The partial deformation of flexible brim 507 ensures excellent electrical contact via rim 513 between ground insert 501 and connector end 4 and provides enhanced RF shielding.

Both ground insert 401 and ground insert 501 are preferably formed using a progressive die process, with stamping in successive stages.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A port terminator for use in a coaxial cable system, comprising:

an outer nut;

the outer nut having first and second chambers;

an inside of the first chamber having at least one thread therein;

a ground insert positioned inside the second chamber;

the ground insert being electrically conductive;

the ground insert having a capture portion, a middle portion, and a deformable portion, with the capture portion connected to the middle portion, and the middle portion connected to the deformable portion via a transition band;

a termination resistor including a ground portion and a conductor portion, wherein an electrical resistance is electrically connected between the conductor portion and the ground portion; and the ground portion of the termination resistor being held inside and making electrical contact with the capture portion of the ground insert.

2. A port terminator according to claim 1, wherein the deformable portion includes a plurality of flat petals and a plurality of biased petals.

3. A port terminator according to claim 2, wherein the flat petals are alternated with the biased petals.

4. A port terminator according to claim 1, wherein the deformable portion includes a flexible brim.

5. A port terminator according to claim 1, wherein the outer nut is of a non-electrically conductive material.

6. A port terminator according to claim 5, wherein when the port terminator is connected to an equipment port, and wherein the equipment port includes a conductor port and a connector end, an electrical path is established from the conductor port to the termination resistor to the ground insert to the connector end.

7. A port terminator according to claim 1, wherein the capture portion is connected to the middle portion via an angled portion.

8. A method for manufacturing a port terminator for use in a coaxial cable system, comprising the steps of:

forming an outer nut having first and second chambers;

forming at least one thread on an inside of the first chamber;

forming an electrically conductive ground insert, wherein the ground insert includes a capture portion, a middle portion, and a deformable portion, with the capture portion connected to the middle portion, and the middle portion connected to the deformable portion via a transition band;

positioning the ground insert inside the second chamber;

providing a termination resistor including a ground portion and a conductor portion, wherein an electrical resistance is electrically connected between the conductor portion and the ground portion;

positioning the ground portion of the termination resistor inside the capture portion of the ground insert; and fastening the ground portion of the termination resistor to the capture portion of the ground insert, thereby making good electrical contact between the termination resistor and the ground insert.

9. A method according to claim 8, wherein the step of forming the deformable portion includes forming a plurality of flat petals and a plurality of biased petals.

10. A method according to claim 9, wherein the step of forming the deformable portion includes alternating the flat petals with the biased petals.

11. A method according to claim 8, wherein the step of forming the deformable portion includes forming a flexible brim.

12. A method according to claim 8, wherein the step of forming the outer nut includes forming the outer nut of a non-electrically conductive material.

13. A method according to claim 12, wherein when the port terminator is connected to an equipment port, and wherein the equipment port includes a conductor port and a connector end, an electrical path is established from the conductor port to the termination resistor to the ground insert to the connector end.

14. A method according to claim 8, wherein the step of forming an electrically conductive ground insert includes connecting the capture portion to the middle portion via an angled portion.

15. A port terminator for use in a coaxial cable system, comprising:

an outer nut;

the outer nut having first and second chambers;

an inside of the first chamber having at least one thread therein;

a ground insert positioned inside the second chamber;

the ground insert being electrically conductive;

a termination resistor including a ground portion and a conductor portion, wherein an electrical resistance is electrically connected between the conductor portion and the ground portion;

the ground insert including means for receiving and being electrically connected to the ground portion of the termination resistor; and the ground insert further including deformable means for establishing electrical contact with a connector end of an equipment port when the port terminator is connected to the equipment port, such that an electrical path is established from a conductor port of the equipment port to the termination resistor to the ground insert to the connector end of the equipment port.

16. A port terminator according to claim 15, wherein the deformable means includes a plurality of flat petals and a plurality of biased petals.

17. A port terminator according to claim 16, wherein the flat petals are alternated with the biased petals.

18. A port terminator according to claim 15, wherein the deformable means includes a flexible brim.

19. A port terminator according to claim 15, wherein the outer nut is made of a non-electrically conductive material.

20. A port terminator according to claim 15, wherein the termination resistor is a peanut resistor.

* * * * *